United States Patent [19]

Yuki et al.

[11] Patent Number: 4,520,443

[45] Date of Patent: May 28, 1985

[54] CONTROL DEVICE FOR LOADING AND UNLOADING MECHANISM

[75] Inventors: Katsumi Yuki, Toyota; Susumu Yoshida, Aichi; Mineo Ozeki, Ichinomiya; Yasuyuki Miyazaki, Aichi; Masaru Kawamata, Numazu, all of Japan

[73] Assignees: Kabushiki Kaisha Toyoda Jidoh Shokki Seisakusho; Kabushiki Kaisha Meidensha, both of Japan

[21] Appl. No.: 364,404

[22] Filed: Mar. 31, 1982

[30] Foreign Application Priority Data

Mar. 31, 1981 [JP] Japan ..... 56-47737
Mar. 31, 1981 [JP] Japan ..... 56-45960[U]

[51] Int. Cl.[3] ..... B66F 9/06

[52] U.S. Cl. ..... 364/424; 414/273; 414/636

[58] Field of Search ..... 364/424, 478, 562; 340/686; 414/272, 273, 274, 275, 674, 632–638, 699; 187/29 R, 29 A, 29 B; 212/154

[56] References Cited

U.S. PATENT DOCUMENTS 3,993,166 11/1976 Senour ..... 414/674
4,068,773 1/1978 Downing et al. ..... 414/636
4,168,934 9/1979 Downing et al. ..... 414/636
4,411,577 10/1983 Shearer, Jr. ..... 414/273
4,411,582 10/1983 Nakada ..... 414/636

FOREIGN PATENT DOCUMENTS 3106226 2/1981 Fed. Rep. of Germany .
20263 2/1978 Japan .
37378 11/1979 Japan .

*Primary Examiner*—Gary Chin
*Attorney, Agent, or Firm*—Lowe, King, Price & Becker

[57] ABSTRACT

A control device for loading and unloading mechanism adapted to be incorporated in a fork lift truck comprises a sensor unit 100 including a lifting height sensor 102, a tilting angle sensor 104, and a load sensor 106, a control unit 200 comprising a control command producing circuit 240 constituted by a microcomputer 230 producing a control command on the basis of comparing calculation between the output of the sensor unit 100 and the concerned data stored in the microcomputer 230. The control device further comprises actuators 322, 324 including servomotor driving circuit therein responsive to the control command fed from the control unit 200, and a hydraulic pressure driving circuit 340 for hydraulically controlling a lift cylinder 346 and a tilt cylinder 348 in accordance with the corresponding output of each actuator, respectively. The control device is capable of effecting a automatic running attitude control due to the data stored in the microcomputer 230. The control device further makes it possible to automatically effect a series of sequential loading and unloading work including a lifting height operation and a tilting angle control. Preferably, the control device comprises a means for manually adjusting an attitude angle of the fork during loading and unloading work. Further, in view of safety, the control device is constituted so that an adjustable running attitude angle of the fork is limited to a predetermined region.

10 Claims, 18 Drawing Figures

CONTROL DEVICE FOR LOADING AND UNLOADING MECHANISM

BACKGROUND OF THE INVENTION

The present invention relates to a control device for a loading and unloading mechanism, and more particularly to a control device for a loading and unloading mechanism incorporated in a fork lift truck and effecting a running attitude control due to lifting height control of a fork or tilting angle control of an upright. Particularly, the present invention is concerned with a control device for a loading and unloading mechanism for effecting an operation for horizontally positioning a fork or running attitude operation in relation to a lifting height control. Specifically, the present invention relates to a control device for a loading and unloading mechanism automatically controlled in accordance with lifting height data and/or tilting angle data stored in a microcomputer.

As is well known, a fork lift truck comprises a loading and unloading mechanism and a vehicle body. The loading and unloading mechanism comprises a vertically elongated guide rail called an "upright", and a fork slidable in the upright. The mechanism further comprises a hydraulic member, as for example, a hydraulic cylinder for lifting and lowering the fork and tilting the upright.

In connection with the prior art loading and unloading control, for instance, lifting height control, drawbacks are pointed out as follows: Recently, there is a tendency that the lifting height becomes high when loading and unloading work is effected with a fork lift truck. For instance, the piling and unloading may be effected at heights greater than 10 m. In such a case, it is difficult for an operator to adjust the loading and unloading mechanism so that the fork is placed at the predetermined height, looking at the top of the fork positioned above about 10 m relatively to the seat of the operator. Accordingly, it is desirable for the operator to easily effect piling and unloading the load at the predetermined position.

In order to embody this requirement in the prior art, the upright is provided with a limit switch for stopping the fork at a predetermined position. When the fork reaches the predetermined position, for instance, 8.5 m, the control device is designed so as to light a lamp provided at the operator's unit or break a driving power supply for loading and unloading operation. Usually, a load is unloaded on a shelf with a plurality of steps. For this reason, in order to determine the desired position it is required to select the step. The provision of a predetermined number of limit switches, for instance ten, is required in order to meet the height of the shelf. Further, it happens that the piling and unloading is required at the another shelf according to the change of the working place. In such a case, if the height of the shelf is different from that of the prior one, a more complicated control device is required. Actually, it has been impossible to effect the piling and unloading operation.

Reference is made to a method for performing a loading and unloading operation. The method comprises the steps of running a fork lift truck to the position for piling a load, lifting a fork to the lifting height position, advancing the fork lift truck, mounting a load on a fork, adjusting a tilting angle of an upright in order to horizontally position the fork, and lowering the fork to the position required for safe running. The method further comprises the steps of tilting the upright in the backward direction by an angle suitable for safe running, running the fork lift truck to the position for unloading a load, and tilting the upright in the forward direction in order to horizontally position the fork after the fork is lifted to the position required for unloading, or effect the lifting height operation of the fork and the tilting operation in the forward direction at the same time. Thereafter, the unloading operation follows in a reverse order. For a second time, the reverse operation is effected so that the fork is placed in the running attitude. The fork lift truck is returned to the position for piling.

As stated above, the prior art loading and unloading operation effected with a fork lift truck requires an operation for lifting and lowering a fork, an operation for tilting an upright, and a running operation in accordance with a complicated procedure with respect to each loading and unloading operation, with the result that the efficiency of the work is lowered. Further, as stated above, when a load is unloaded, the lifting height operation of the fork and the tilting angle operation of the upright are carried out at the same time or the tilting angle operation is effected and thereafter the backwardly inclining operation is effected. Accordingly, the lifting height operation is effected under the condition that the load is not placed in perfect horizontal condition, thereby to become unstable, which brings about a safety problem.

Further, from the point of view of the system control in the prior art, a plurality of analog control circuits, such as, comprising combination of relay circuits respectively provided with respect to the controlled system, as for example, lifting height control are incorporated in the control unit of the control device for loading and unloading mechanism. Prior to the lifting work, an operator effects various settings according to the lifting height condition required for loading and unloading work and then starts a lifting height operation. In this instance, an automatic control system is constituted, which includes therein a valve opening control system provided with respect to a hydraulic pressure circuit for actuating a lift cylinder. The lifting height control is effected so as to control the valve opening control system due to the deviation between an actual lifting height above said setting value. However, when the setting is changed to a great extent according to the change of the loading and unloading working place, it is required to adjust the automatic control system in order to stabilize the control system. Alternately, it happens that the desired control accuracy cannot be obtained. Further, such a lifting height control is effected in a series of sequential control for loading and unloading work with the lifting height control being related to various kinds of controls. Accordingly, it is desirable to supervise the whole system control in view of the simplicity of the circuit and harmonious execution of the control.

In view of this, another attempt has been made. The programmed series of sequential control matching with the objective loading and unloading operation is stored in a computer, such as a microcomputer. When, for instance, lifting height control is effected, the concerned programmed routine for lifting height control is called from the program to effect a lifting height control due to the execution of the programmed routine.

In this instance, prior to lifting height work, the setting is effected by memorizing the objective lifting height into the microcomputer. When a push-button for starting an automatic lifting height is pushed, the execution of the program for lifting height control routine starts. Thus, the automatic control system including therein the above-mentioned valve opening control system becomes operative on the basis of the command being fed from the microcomputer so that the fork moves to the objective lifting height to automatically stop thereat. Accordingly, when the change of the setting is required, the changed lifting height is memorized into the microcomputer. When calling routines for lifting height control, it is sufficient to call the concerned routine in such a manner to distinguish it from the other.

These computer controlled devices for loading and unloading mechanisms are provided with a pair of limit switches for setting a horizontal position of a fork and for setting an angle or running attitude of the fork responsive to the tilt cylinder for tilting the upright in the forward and backward directions along which the fork is slidably provided. When a horizontally positioning push button switch is pushed in order to horizontally position the fork at the lifting height position in the working place, the fork is moved from an inclined position to the holizontal position and is stopped thereat. When a push button switch for taking the fork to the running attitude position is pushed, the fork is moved to the predetermined position suitable for running and at the same time is rotated to the predetermined inclined position suitable for running, and is stopped thereat.

However, when the limit switch for setting an angle for running attitude becomes operative, the fork is always stopped at the predetermined inclined position. Accordingly, it is impossible to adjust the fork so that the angle of the fork is suitable for different kinds and shapes of loads. For this reason, it is likely that the load will be damaged or an unstable running condition will be provided.

In general, as the lifting height of the loaded fork increases, the attitude thereof becomes unstable. However, it is solely the horizontal position of the fork and the running attitude thereof which are controlled. As a result, it is difficult to adjust a backwardly inclined angle of the upright suitable for lifting height of the fork. If the backwardly inclined angle of the upright is set to be large, when the fork is lifted to the height lifting position, the center of gravity of the upright becomes unstable, which brings about a safety problem.

SUMMARY OF THE INVENTION

With the above in mind, a primary object of the present invention is to provide a fork attitude control device for a loading and unloading mechanism which makes it possible to automatically perform attitude adjustments, required after pick-up or stacking of a load is completed, in accordance with the data stored in a memory and sensed values indicative of lifting height and inclination, in which the load being applied to the fork is taken into account.

Another object of the invention is to provide a fork attitude control device for a loading and unloading mechanism wherein the attitude adjustments include a first type of operation for horizontally positioning the fork and/or a second type of operation for raising and lowering the fork, and tilting an upright, thereby perforing the attitude adjustments by which the fork assumes a predetermined running attitude, thus facilitating the loading and unloading work to improve the working efficiency.

It is another object of the invention to provide a fork attitude control device for a loading and unloading mechanism, wherein the control device includes inclination adjusting means which adjusts the inclination of the fork to match a predetermined value according to the manual operation thereof, when the above-mentioned fork attitude adjustments are performed, Another object of the present invention is to provide a fork attitude control device for a loading and unloading mechanism, wherein when the above-mentioned fork attitude adjustments are performed, an adjustable range of running attitude inclination of the fork becomes more restricted as the lifting height value of the fork increases, thus improving safety in the attitude control.

According to the present invention, there is provided a control device for a loading and unloading mechanism adapted to be incorporated in a fork lift truck comprising: a sensor unit including at least a lifting height sensor for measuring a lifting height of a fork and a tilting angle sensor for measuring a tilting angle of an upright, a control unit responsive to the output signal of the sensor unit, the control unit effecting a calculation on the basis of the output signal therefrom and producing a predetermined control signal according to the calculated value, a servomotor driving circuit responsive to the predetermined control signal of the control unit, and a hydraulic pressure driving circuit for lifting and lowering a fork and tilting an upright, the opening angles of each of the valve members for actuating a lift cylinder and a tilt cylinder being adjusted in accordance with the output signal of the servomotor driving circuit, characterized in that the control unit comprises an interface circuit for inputting the output signal from the sensor unit, and a control command producing circuit comprising a memory for storing lifting height data and a tilting angle data, and a data setting means for setting the data to the memory, and in that the control command producing circuit produces a control command on the basis of a comparison between the output of the sensor unit and the concerned data stored in the memory to effect a desired attitude control of the fork in accordance with the control command.

BRIEF DESCRIPTION OF THE DRAWINGS

The feature and advantages of a control device for loading and unloading mechanism according to the present invention will become more apparent from the description taken in conjunction with the accompanying drawings, in which.

DETAILED DESCRIPTION OF THE PREFERRED EMBODIMENTS

Figure 1:
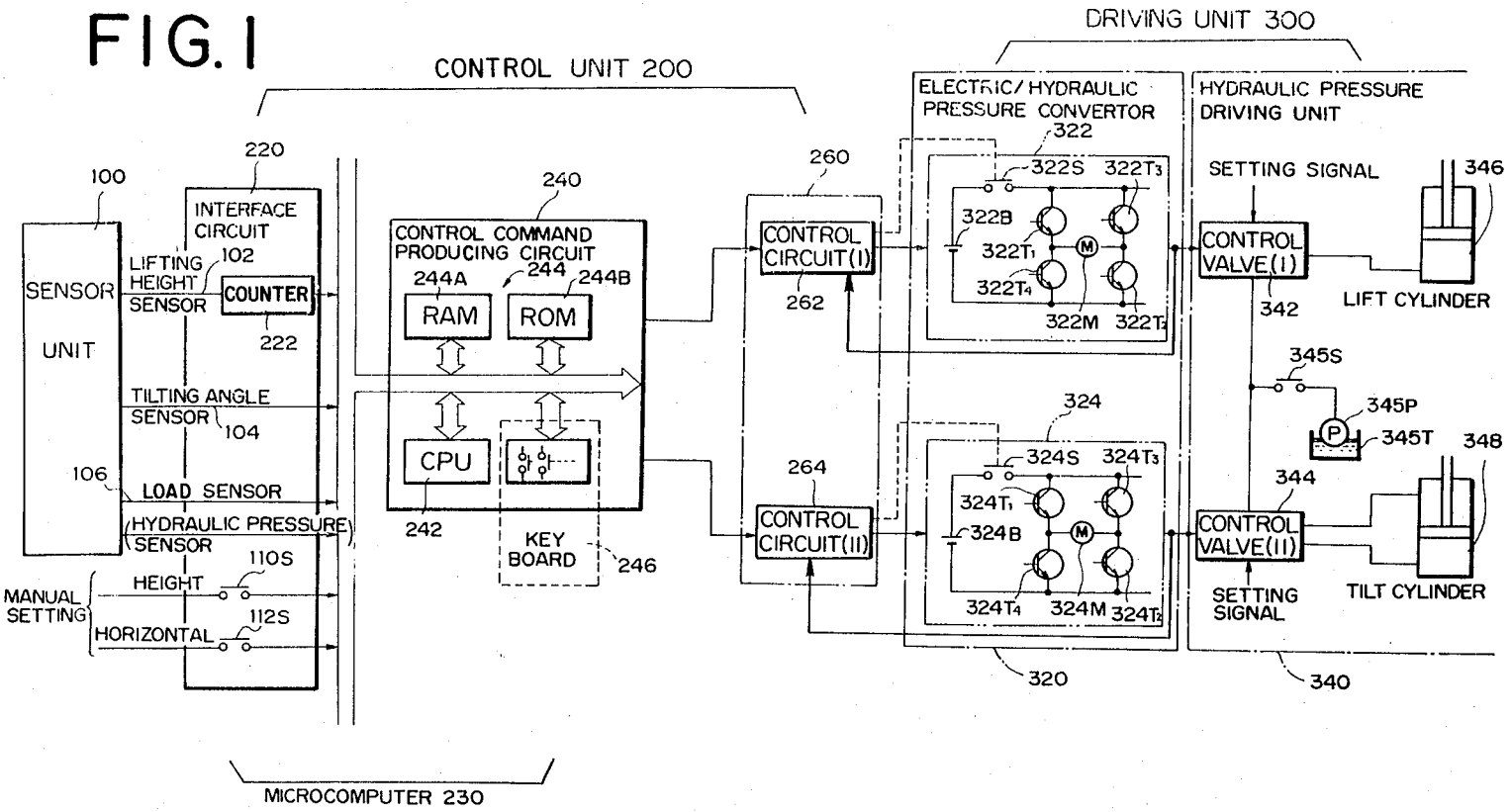
FIG. 1 is a block diagram schematically illustrating a system construction of a control device for a loading and unloading mechanism according to the present invention.

FIG. 1 is a block diagram illustrating a system construction of a control device for loading and unloading mechanism according to the present invention.

Reference numeral 100 denotes a sensor unit including a lifting height sensor 102, a tilting angle sensor 104, and a load sensor 106 (hydraulic pressure sensor). Reference numeral 200 denotes a control unit comprises an interface circuit 220 including a lifting height counter 222, a control command producing circuit 240 constituted by a microcomputer 230 responsive to the output of the sensor unit 10 fed through the interface circuit 220, and a control circuit 260 responsive to the control command being output from the control command producing circuit 240. Reference numerals 110S and 112S denote contacts for manual setting, which are closed by external commands indicative of lifting height and the horizontal position of the fork, respectively.

More particularly, the control command producing circuit 240 comprises a central processing unit (CPU) designated by reference numeral 242, a memory 244 essentially consisting of a random access memory (RAM) designated by reference numeral 244A, a read only memory (ROM) designated by reference numeral 244B in which predetermined lifting height, tilting angle, load, or other data are stored, and data setting means 246, as for example, comprising a key board for setting desired data by an operator. The control command producing circuit 240 produces a control command based on the output of the sensor unit 100 and the data in connection with lifting height, tilting angle, or load stored in the memory 244. The control circuit 260 comprises a first control circuit 262 for lifting height control system and a second control circuit 264 for tilting angle control system.

Reference numeral 300 denotes a driving unit comprising an electric/hydraulic pressure converter 320 and a hydraulic pressure driving unit 340. The electric/-hydraulic pressure converter 320 comprises a first and a second actuators 322 and 324 responsive to the output of the first and second control circuits 262 and 264, respectively. The first actuator 322 comprises a servomotor driving circuit (referred to later) essentially consisting of switching transistors $322T_1$ to $322T_4$ constituting an inverter for controlling a driving motor 322M, and a contact 322S for connecting a DC power supply 322B to the inverter on the basis of the command fed from the first control circuit 262, and a link mechanism (not shown) for joining the output shaft (not shown) of the driving motor 322M to a lift valve member referred to soon. Likewise, the second actuator 324 comprises a servomotor driving circuit (referred to later) essentially consisting of switching transistors $324T_1$ to $324T_4$ constituting an inverter for controlling a driving motor 324M, and a contact 324S for connecting a DC power supply 324B to the inverter on the basis of the command fed from the second control circuit 264, and a link mechanism (not shown) for joining the output shaft (not shown) of the driving motor 324M to a tilt valve member referred to soon. The hydraulic pressure driving unit 340 comprises a first and a second control valves 342 and 344 responsive to the first and the second actuators 322 and 324, respectively. The first control valve 342 is connected to a lift cylinder 346 for controlling a lifting height while the second control valve 344 is connected to a tilt cylinder 348 for controlling a tilting angle. Between the first and second control valves 342 and 344, there is provided a hydraulic pump 345P for supplying a suitable hydraulic oil thereto. Reference numeral 345T denotes a hydraulic oil tank. Reference numeral 345S denotes a contact provided in an electromagnetic valve (not shown) for feeding and interrupting a hydraulic oil fed from the hydraulic pump 345P in accordance with an external command. The above-mentioned first control circuit 262, the first actuator 322, the first control valve 342, and the lift cylinder 346 constitute a servo control circuit for lifting height control system. Likewise, the above-mentioned second control circuit 264, the second actuator 324, and the second control valve 344, and the tilt cylinder 348 constitute a servo control circuit for tilting angle control system.

Figure 2:
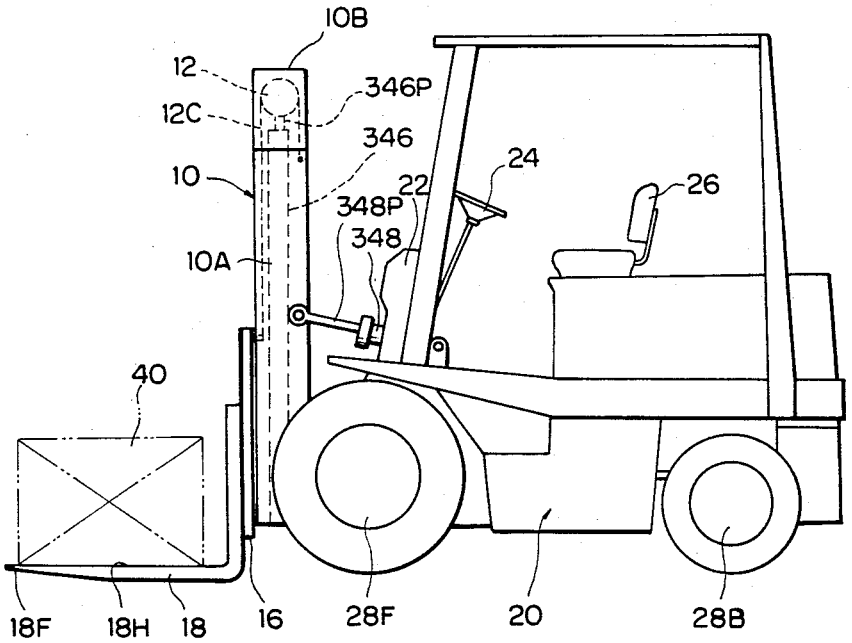
FIG. 2 is a side view illustrating a fork lift truck to which the present invention is applied.

FIG. 2 shows a fork lift truck to which the control device for loading and unloading mechanism according to the present invention is applied. Reference numeral 10 denotes a pair of uprights provided on the right and left sides, each comprising an outer mast 10A and an inner mast 10B supported by the outer mast 10A so as to move in the upper and lower directions. The lower end portion of the outer mast 10A is mounted on the front side of a truck body 20 so as to fluctuate. Reference numeral 348 denotes the above-mentioned tilt cylinder mounted to the front portion of truck body 20. A piston 348P of the tilt cylinder 348 is joined to the outer mast 10A so that the tilting angle in the forward and backward directions of the upright 10 can be adjusted. Reference numeral 346 denotes the above-mentioned lift cylinder mounted on the central portion between the pair of uprights 10, wherein the piston 346P thereof is joined to the inner mast 10B through a chain wheel supporter 10S so that the height of the inner mast 10B can be adjusted in the upper and lower directions. Reference numeral 12 denotes a chain wheel rotatably mounted on the upper end of the piston 346P. A chain 12C is fitted over the chain wheel 12. The one end of the chain 12C is joined to the outer mast 10A or the lift cylinder 346. The other end of the chain 12C is joined to a movable member 16 slidably fitted into the inner mast 10B or a fork 18 supported by the movable member 16.

Reference numeral 18F denotes a top portion or free end of the fork 18. A load designated by reference numeral 40 is mounted on a horizontal portion 18H of the fork 18. Reference numeral 24 denotes a steering wheel for usual running control. Reference numeral 26 denotes a seat for an operator. Reference numerals 28F and 28B denote a front wheel and a rear wheel, respectively.

Figure 3:
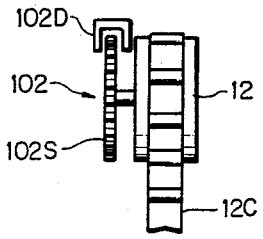
FIG. 3 is a side view illustrating a lifting height sensor incorporated in the fork lift truck shown in FIG. 2.

Accordingly, when the lift cylinder 346 becomes operative, the inner mast 10B elevates. According to this movement, the fork 18 which is attached to the chain 12C moves upwards along the inner mast 10B. As a result, a load 40 mounted on the fork 18 is lifted. FIG. 3 shows a detail of the portion with which the above-mentioned lifting height sensor 102 is associated. The lifting height sensor 102 comprises a disk 102S having a plurality of slits coaxially mounted to the chain wheel 12 and a sensor unit 102D, which may be an electromagnetic type, in the embodiment, for instance, consisting of a light source and a light detector (not shown). The slitted disk 102S rotates in accordance with the rotation of the chain wheel 12. The number of the slits passing the light source end detector is detected by the sensor unit 102D. More particularly, the sensor unit 102D produces a pulse signal corresponding to the number of the slits, thereby detecting the lifting height.

Figure 4:
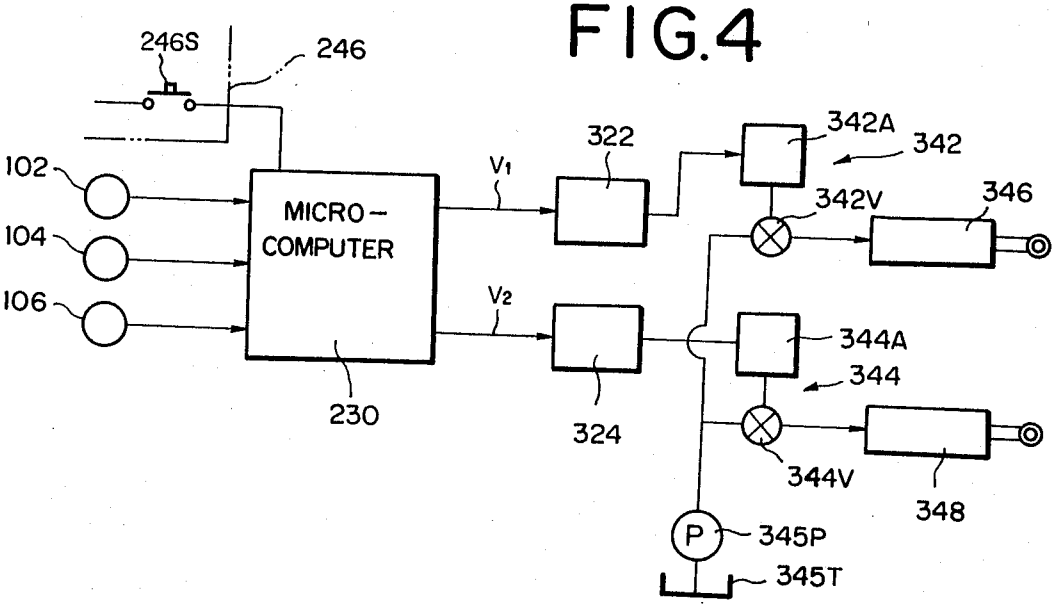
FIG. 4 is a block diagram illustrating a first embodiment of a control device for loading and unloading mechanism according to the present invention.

FIG. 4 is a block diagram showing a first embodiment according to the present invention, wherein the same reference numerals denote corresponding parts shown in FIG. 1 illustrating a system construction. The feature of the first embodiment resides in that a series of sequential operations are provided, including a horizontal positioning operation performed after picking-up of a load or piling is completed, and a lifting and lowering operation of a fork and a tilting operation of an upright effected in order to select a predetermined running attitude is automatically performed due to the execution of a program stored in a microcomputer.

A program for running attitude control is stored in the memory 244 (see FIG. 1) of the microcomputer 230. When a push-button switch 246S for an automatic running attitude command assembled in the key board 246 is pushed, the program is executed due to outputs of the lifting height sensor 102, tilting angle sensor 104, and load sensor 106, each of which is rendered as an external input to the microcomputer. An automatic control, including a hydraulic control system for lift cylinder 346 and a hydraulic control system for tilt cylinder 348, is effected on the basis of control commands $V_1$ and $V_2$ output due to the execution of the program. The above-mentioned load sensor 106 is provided for detecting the weight of a load in order to correct the objective value required for horizontal positioning of the fork in accordance with variation of a bending amount of the upright 10 and/or the fork 18 according to the weight of the load. For instance, the load sensor 106 detects a hydraulic pressure of the lift cylinder 346 and/or the air pressure of the front wheel 28F. The first control valve 342 comprises an actuator 342A and a valve unit 342V. Likewise, the second control valve 344 comprises an actuator 344A and a valve unit 344V.

Figure 5:
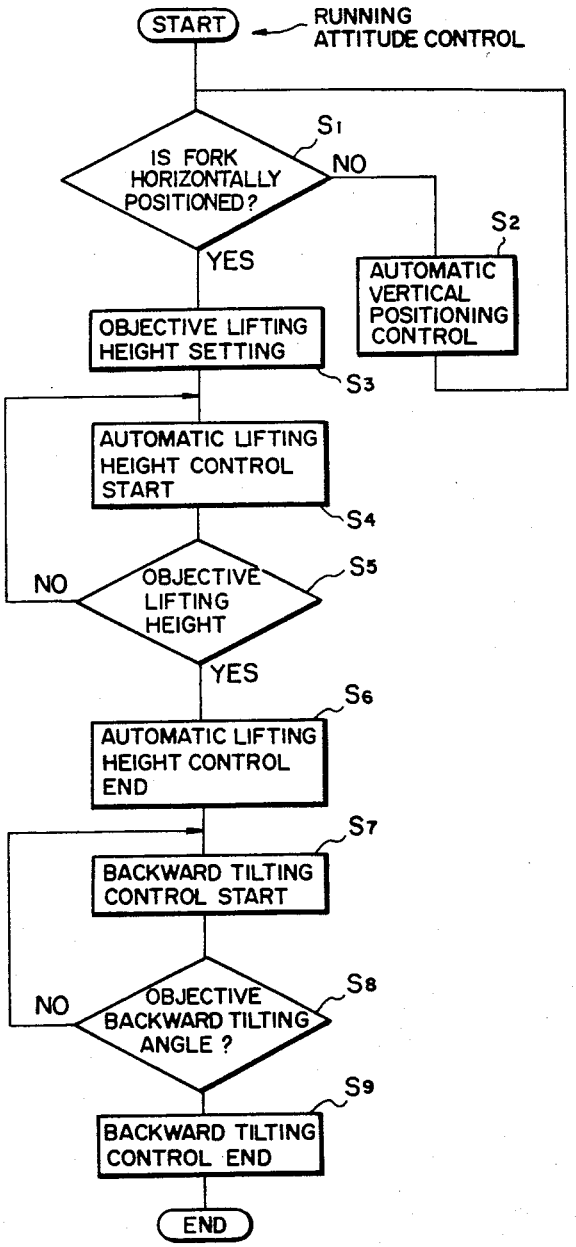
FIG. 5 is a flow chart for effecting a running attitude control with the control device shown in FIG. 4.

FIG. 5 is a flow chart for running attitude control effected with the control device shown in FIG. 4. After a load is mounted on the fork 18 at the position for picking up a load, or a load is unloaded at the unloading position, the running attitude control starts by actuating the push-button switch 246S for entering an automatic running attitude control.

At the step $S_1$, the vertical positioning of the upright 10 is effected. In this instance, "upright vertical positioning" does not means that the upright 10 is vertical with respect to ground. That is, it is first determined at step 5, whether the horizontal portion 18H of the fork 18 is placed horizontally with respect to ground. When effecting this judgement, first of all, the tilting angle correction value is read out, providing the tilt correction which is required for placing the horizontal portion 18H of the fork 18 in the horizontal condition due to the bending of the front wheel 28F or the bending of the upright 10 and the fork 18. The valve is in the read only memory (ROM) 244B with respect to the load data sensed by the load sensor 106. Then, it is determined whether the portion 18H of the fork 18 is positioned horizontally with respect to ground on the basis of the tilting correction data and the inclined angle data of the upright 10 with respect to ground sensed by the tilting angle sensor 104.

When an adjustment of the inclined angle of the upright 10 is required as a result of the judgement of the step $S_1$, the following method is carried out. This method comprises the steps of setting a tilting angle objective value of the upright 10 calculated by effecting an addition and/or a reduction between the tilting correction value and the inclined angle data of the upright 10, and entering an automatic vertical positioning control (step $S_2$) for automatically controlling the tilt cylinder 348 so as to reach the setting value.

The horizontal control of the fork 18 is effected based on the automatic vertical positioning control. Upon completion of this control, in order to lower the fork 18 to the height (for instance, 30 cm above ground) appropriate for running, the lifting height data is read out from the ROM 244B as shown in the step $S_3$. The program execution enters an automatic lifting height control (step $S_4$) for automatically controlling the lift cylinder 346 under the condition that this lifting height data is the objective value for effecting a lifting height control, and the output of the lifting height sensor 102 is provided as a feedback value. The judgement as to whether the fork 18 is lowered to the objective height suitable for running by the automatic lifting height control is effected at the step $S_5$. Thus, when the feedback lifting height of the fork 18 is equal to the objective lifting height, the program execution enters the automatic lifting height stopping control (step $S_6$).

After the predetermined lifting height control of the fork 18 is completed, the backward tilting control of the upright 10 does required so that the load 40 is not slip or drop even in the event of sudden starting or breaking. As shown in the step $S_7$, the program execution enters an automatic backward tilting angle control for automatically controlling the tilt cylinder 348 under the condition that the backward tilting angle data read from the memory 244, for instance, ROM 244B is an objective value, and the output of the tilting angle sensor 104 is a feedback value. When the upright 10 (the fork 18) is placed in the predetermined backward tilting angle position (step $S_8$) by the automatic backward tilting angle control, the automatic backward tilting control is completed (step $S_9$). Thus, the automatic running attitude control is completed.

The control device according to the first embodiment of the present invention makes it possible to smoothly effect a control from the piling or unloading operation to the running attitude control solely by the actuation of the switch 246S for effecting an automatic running attitude. That is, the horizontal portion 18H of the fork 18 is controlled so that it is placed in horizontal condition. Then, the fork is lifted or lowered to the predetermined position suitable for running. Finally, the backward tilting control is effected so that the backward inclined position is suitable for running. Thus, this makes it possible to remarkably lessen the burden for an operator. Further, according to the present embodiment, control is effected in which the variation or deviation with respect to the horizontal position of the fork 18 due to the weight of the load is taken into account, thereby improving the safety to increase the working efficiency.

Reference is made to the second embodiment of the invention.

Figure 7A:
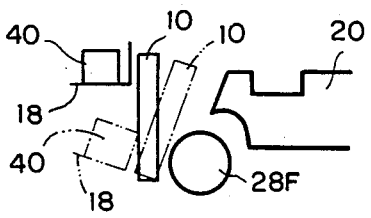
FIG. 7A is a schematic view for explaining an automatic loading and unloading control carried out by horizontal positioning a fork and then lifting the fork in the second embodiment of the present invention.

When a loading and unloading operation work is effected with a fork lift truck, the process is classified into two operational modes. One is to tilt the upright 10 in the forward and backward directions with the tilt cylinder 348. The other is to lift or lower the fork 18 with the lift cylinder 346. For instance, when picking up a load from a shelf to move it to another location, that is, when effecting a piling work, it is required to run the fork lift truck under the condition that the upright 10 is placed in the predetermined backwardly inclined condition where a upright 10 is inclined from the position having a first angle (hereinafter referred to as the angle $\theta_0$) to a position having a second angle (hereinafter referred to as the angle $\theta_1$), as shown in FIG. 7A. Accordingly, when the loaded fork lift truck reaches the shelf to which the load is to be transferred, the angle of the upright is altered from the position of the angle $\theta_1$ to the position of the angle $\theta_0$ for a second time, as required to mount the load on the shelf.

At this time, the angle of the upright 10 and the lifting height of the fork 18 are varied from the condition that the inclined angle is $\theta_1$ and the lifting height of the fork 18 is $h_1$ to the condition that the inclined angle is $\theta_0$ and the lifting height of the fork 18 is $h_2$. In the prior art, as stated above, the backward tilting angle control and the lifting height control are effected at the same time. Alternately, after the lifting height control is effected, the backward tilting angle control is effected. As a result, the load is placed in an unstable condition, which brings about a dangerous condition.

The second embodiment has solved these problems. The feature of the present embodiment resides in that when a load is mounted on a shelf, the actuation of the lift cylinder is effected solely when the fork is placed in horizontal condition, while when a load is picked up from a shelf and is removed to another place, the same action is effected solely when the fork is placed in a horizontal position or backwardly inclined position.

Figure 6:
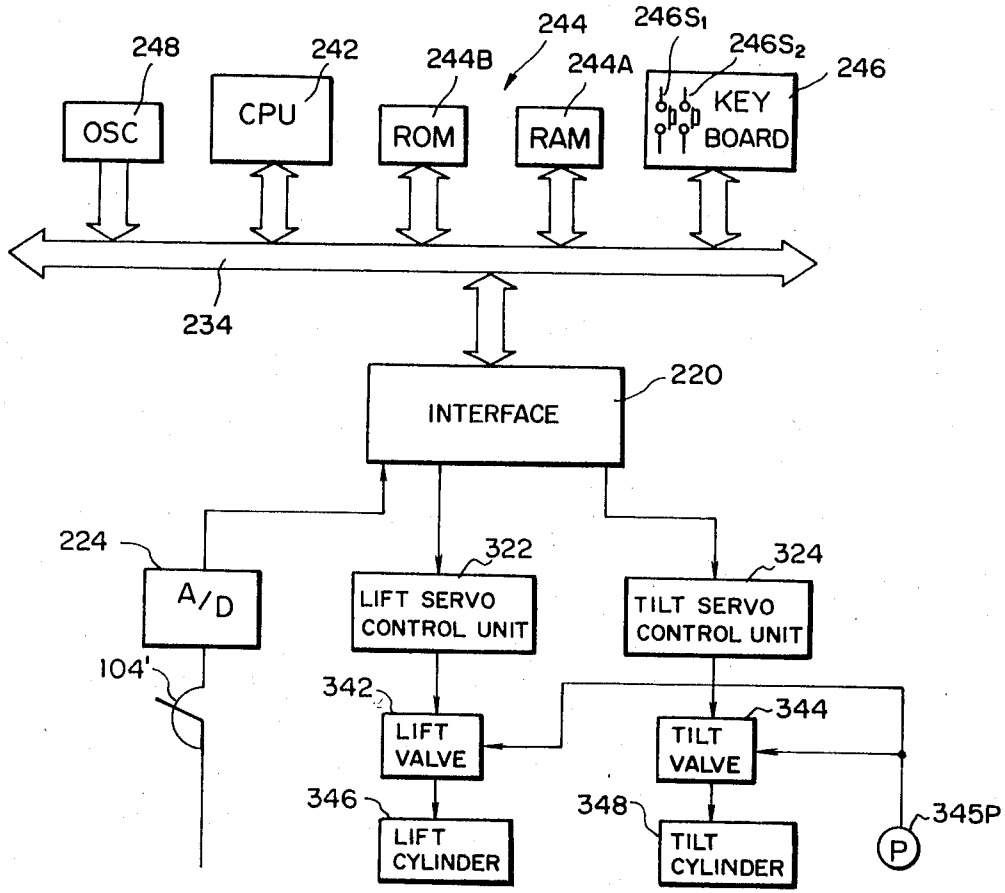
FIG. 6 is a block diagram illustrating a second embodiment of a control device for loading and unloading mechanism according to the present invention.

FIG. 6 is a block diagram illustrating a circuit construction for embodying the second embodiment, wherein the same reference numerals denote corresponding elements of FIG. 1, respectively. Reference numeral 248 denotes an oscillator for a clock signal, although not shown in FIG. 1.

A microcomputer system is constituted by CPU 242, memory 244, key board 246, oscillator 248, interface 220. In this system, the data transfer is effected through bus 234 governed by CPU 242 in accordance with the clock signal. In the embodiment, the tilting angle of the tilt cylinder 348 is sensed by a potentiometer 104'. The sensed analog data is converted into digital data by A/D converter and is fed to the interface 220. The lift servo control unit (first actuator) 322, lift valve 342, and lift cylinder 346 constitutes a servo driving circuit for lifting height control system. The tilt servo control unit (second actuator) 324, tilt valve 344, and tilt cylinder 348 constitutes a servo driving circuit for tilting angle control system.

In operation, at the time of picking up the load from a shelf to another shelf, there occurs a forward inclination for the following reasons: One is that the load is mounted on the fork 18 under the condition that the forward tilting angle of the upright 10 is, for instance, $\theta_2$. Second is that the load mounted on the fork 18 becomes unbalanced due to the discrepancy of the joint between the inner mast 10B and the outer mast 10A. Prior to the loading and unloading operation, the operator presses the push button switch $246S_1$ provided on the key board 246 for controlling tilt cylinder 348. As a result, the signal is fed to the CPU 242. The CPU 242 executes the program for horizontal operation of the fork 18 (the vertical operation of the upright 10) to the ROM 244B. At the same time, CPU 242 instructs the interface 220 so that the output signal of the potentiometer 104' is fed thereinto. At this time, the output signal proportional to the tilting angle from the potentiometer 104' is converted to a digital signal by the A/D converter 224 in accordance with the instruction. The output of the A/D converter 224 is fed to CPU 242 through the interface 220. The CPU 242 designates an address of RAM 244A to store it therein. The result is stored in CPU 242 for a second time. When the upright 10 is placed in a forward inclined condition, CPU 242 feeds a control signal for returning the position of the upright 10 in the horizontal direction to the second actuator 324 through the interface 220. Thus, the upright 10 is controlled in the direction that it is pulled out by the tilt cylinder 348 through the tilt valve 344. The output of the potentiometer 104' varies with time proportionally to the inclined angle of the upright 10. As stated above, the value is written into RAM 244A. When the accumulated result of RAM 244A is equal to the value previously set, CPU 242 produces a command for stopping the output which is fed to the second actuator 324 to the interface 220 to stop the operation of the tilt cylinder 348.

Figure 7B:
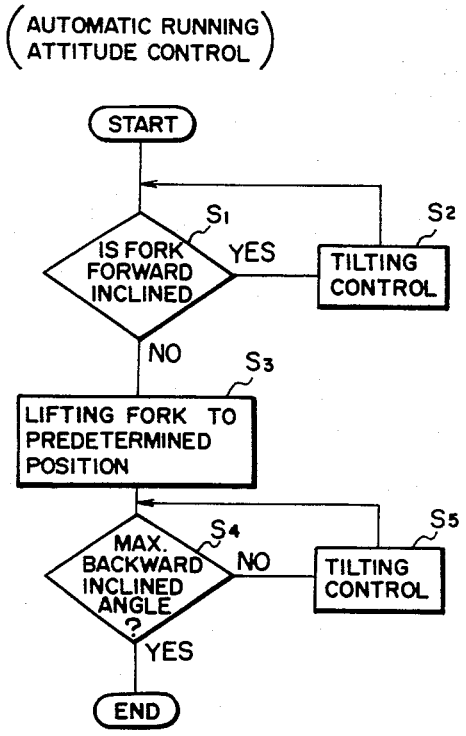
FIG. 7B is a flow chart for effecting the automatic loading and unloading control shown in FIG. 7A.

Thus, the horizontal portion 18H of the fork 18 is placed in a horizontal position as shown by a solid line in FIG. 7B. The above-mentioned control is indicated by steps $S_1$ and $S_2$ in FIG. 7A. When the operator presses the push-button switch $246S_2$ provided on the key board 246, the lift cylinder 346 is controlled in the direction that the piston rod (not shown) thereof is withdrawn shown by the step $S_3$ in FIG. 7B through the interface 220, the first actuator 322, and the lift valve 342 on the basis of the program stored in ROM 244B. As a result, the fork 18 on which the load 40 is mounted is horizontally maintained at the predetermined running position. Accordingly, the fork 18 is controlled in the lowering direction so that the load 40 is held horizontally and is placed in a stable condition, with the result that the load neither slips or falls down.

In order to bring the load 40 from the running position to the other shelf, the fork 18 is controlled by the servo control circuit for tilting angle control system so that the tilting angle thereof is equal to the predetermined angle, for instance, $\theta_1$ as shown in FIG. 2. The control, in this instance, is effected as indicated by the steps $S_4$ and $S_5$ in FIG. 7B. The maximum backwardly inclined position is shown by a broken line in FIG. 7A. Thus, the running attitude control is completed.

When picking up the load from the shelf, if the fork 18 is placed in backwardly inclined position, the program execution is directly shifted to the operation for lowering the lift cylinder 346 as shown in the step $S_3$. In the above-mentioned embodiment, it is described that after the horizontal positioning operation is completed, the operator actuates the push-button swich 246$S_2$ for actuating the lift cylinder 346 thereby to effect an operation of the lift cylinder 346. If a program for controlling the operation of the lift cylinder 346, which shifts in the lowering direction from the position of the fork 18, at which the load is picked up from the high position shelf, to the lower position of predetermined height is stored in ROM 244B, a sequential control including the horizontal positioning operation of the fork 18 and the lowering operation thereof can be effected solely by pressing the push-button switch 246$S_1$ provided on the keyboard 246.

Figure 8A:
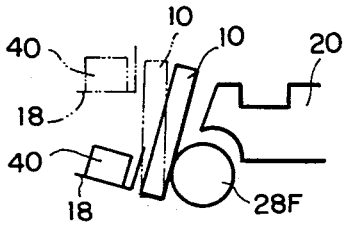
FIGS. 8A and 8B are a schematic view for explaining an automatic loading and unloading control carried out by effecting a tilting angle operation of a fork, effecting a lifting height operation of the fork, and effecting a backward tilting angle operation of the fork, and a flow chart thereof.
Figure 8B:
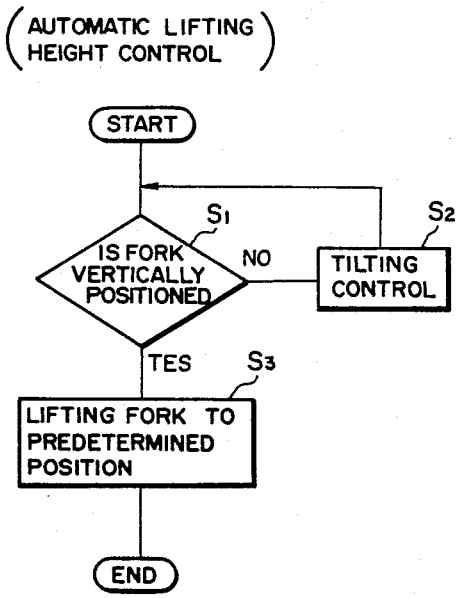

It is now assumed that the load 40 is conveyed under the backwardly inclined condition, as shown by a solid line in FIG. 8A, and then the load 40 is mounted on a shelf positioned above as shown by a dotted line in the same figure. In such a case, the procedure for effecting horizontal operation of the fork and the lifting height operation of the fork can be automatically effected due to the actuation of the push-button switch 246$S_1$. The procedure in this instance is shown in FIG. 8B.

According to the second embodiment of the invention, when the push-button switch 246$S_1$ for horizontal positioning is pushed, the fork on which a load to be lifted or lowered is mounted can be placed in a horizontal condition. Accordingly, lifting and lowering of the load is effected in the a stable condition, thereby enabling a loading and unloading operation to be effected in safety. Further, there does not occur injury to the load due to slipping or dropping thereof. Further, an entire loading and unloading operation can be automatically effected by programming a series of sequential operations including a horizontal positioning operation and a lifting height operation.

Reference is made to the third embodiment of the present invention. The feature of the present embodiment resides in that when a running attitude control is effected, the sensing voltage of the tilting angle adjusting means is compared with the voltage proportional to the backwardly inclined angle of the upright so that the lifting angle of the fork is adjustable according to the kinds of loads and the shape thereof, and when the former is equal to the latter, the operation of the tilt cylinder for tilting the upright is stopped.

Figure 9:
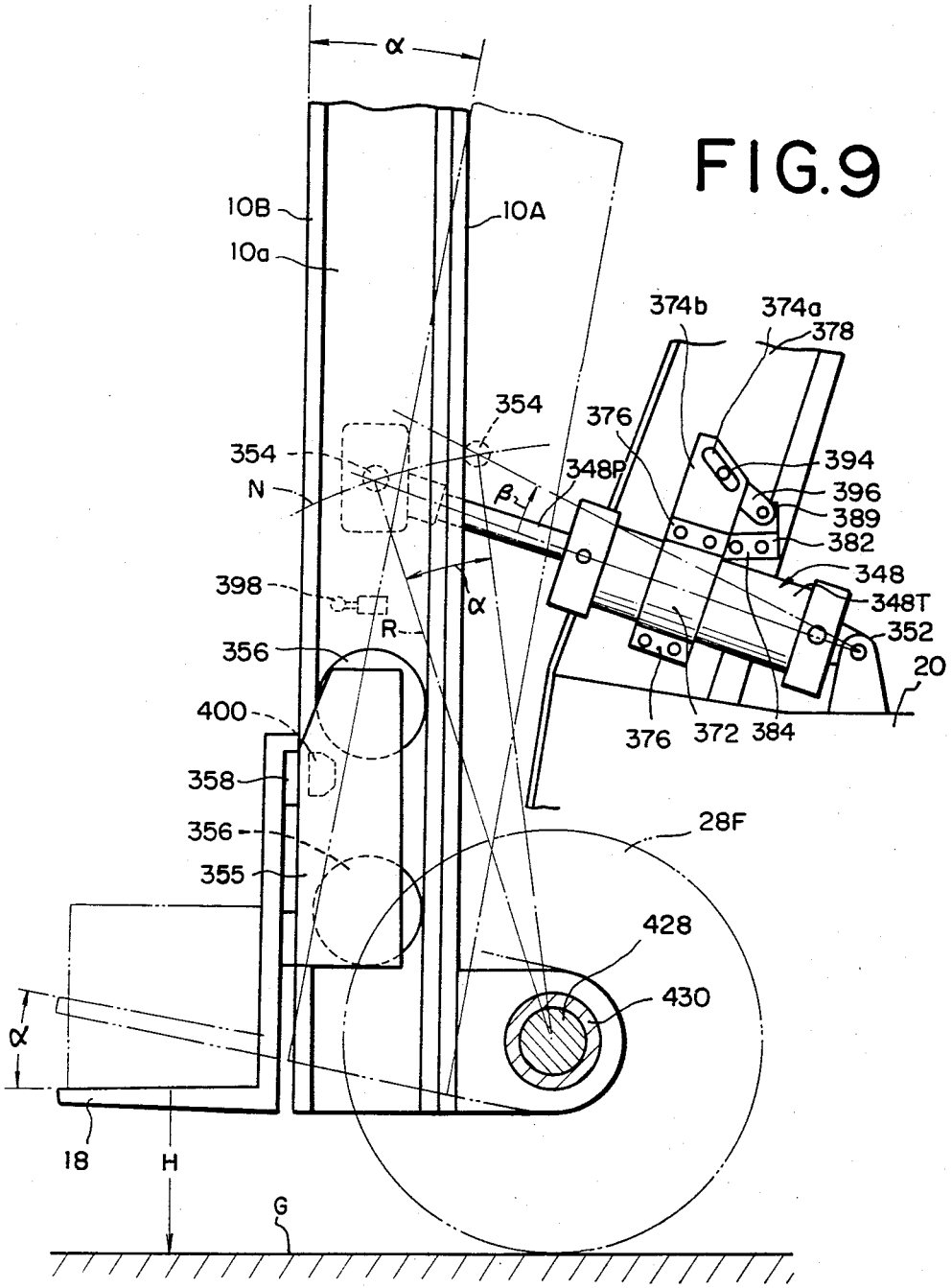
FIG. 9 is an enlarged side view showing a tilting angle adjusting mechanism of an upright assembled into the fork lift truck shown in FIG. 2.

At the front end of the vehicle body 20, as shown in FIG. 9, an axle supporting sleeve 430 for supporting a supporting axle 428 of the front wheel 28F is fixed. The outer mast 10A is supported at the lower end portion thereof on the axle supporting sleeve 430 so that it is inclined in the forward and backward directions. The root of the cylinder body 348T of the tilt cylinder 348 is joined by means of a connecting pin 352 on the upper surface of the vehicle body 20 so as to rotate in the upper and lower directions. The top of the piston 348P of the tilt cylinder 348 is joined to the outer side surface of the outer mast 10A by means of a connecting pin 354 so as to tilt the outer mast 10A in the forward and backward directions.

Assuming that, as an initial condition, the outer mast 10A is placed in the vertical position as shown by solid line shown in FIG. 9. If the piston 348P of the tilt cylinder 348 is withdrawn, the outer mast 10A is rotated in the backward direction with the supporting axle 428 being a center for rotation. As a result, the connecting pin 354 is rotated backward by an angle of $\alpha$ drawing a circular locus N with the radius of R. The tilt cylinder 348 is rotated by an angle of $\beta$ with the connecting pin 352 being the center thereof according to a rotational angle $\alpha$ of the connecting pin 354, that is, the backwardly inclined angle $\alpha$ of the upright 10.

Figure 10:
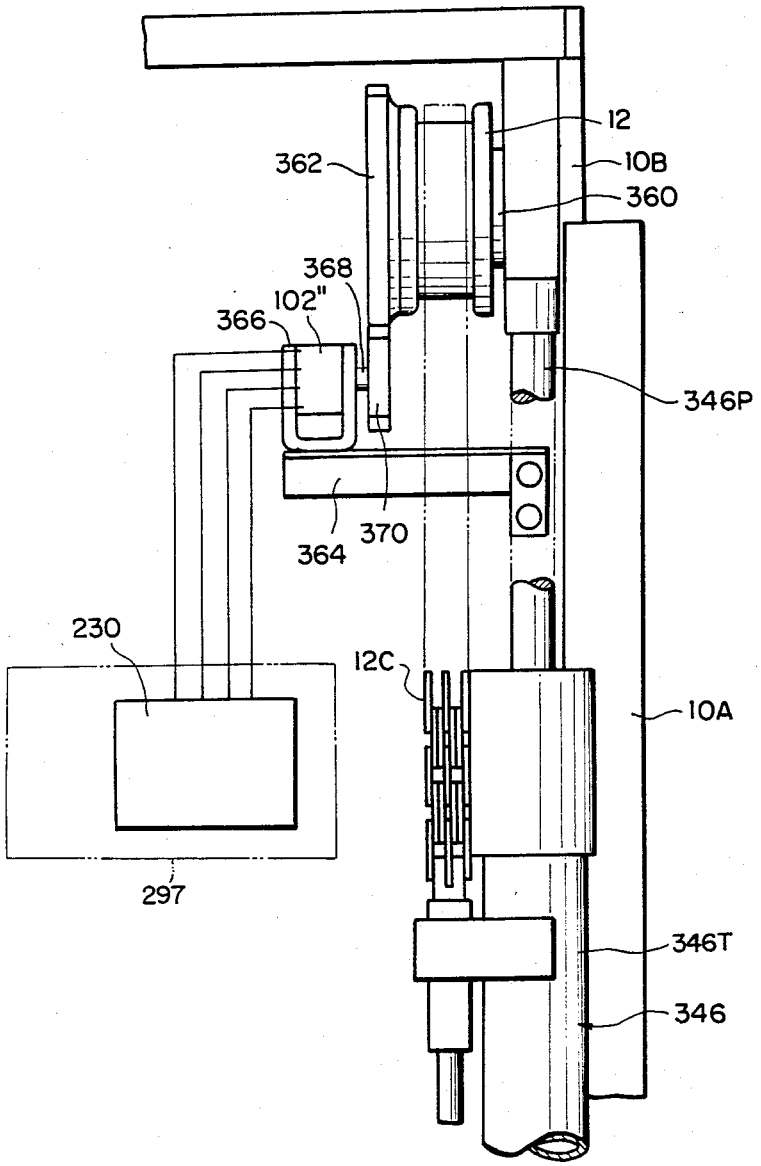
FIG. 10 is a front view illustrating another embodiment of a lifting height sensor incorporating into the fork lifting truck shown in FIG. 2.

The inner mast 10B is mounted, as shown in FIG. 10 inside of the outer mast 10A so that it moves in the upward and downward directions. A lift bracket 355 is mounted, as shown in FIG. 9, in the inner recess 10*a* of the inner mast 10B through a guide roller 356 so that it elevates and lowers. A pair of finger bars 358 for supporting the fork 18 is mounted at the front edge of the bracket 355. The chain wheel 12 (see FIG. 3) is supported at the inside of upper portion of the inner mast 10B, as shown in FIG. 10, by a pivotal axle 360. The intermediate portion of the lift chain 12C, one end is joined at to the upper portion of the cylinder body 346T of the lift cylinder 346 while the other end thereof is joined to the lift bracket 355.

Accordingly, when the piston 346P of the lift cylinder 346 is moved in the upper and lower directions, the inner mast 10B and the chain wheel 12 are moved in the upper and lower directions. As a result, the lift bracket 355 is moved in the upper and lower directions by the lift chain 12C, so that the fork 18 moves in the upper and lower directions at a speed which is twice of that of the inner mast 10B. At this time, the chain wheel 12 is rotated by the lift chain 12C proportional to the moving distance in the upper and lower directions of the fork 18.

As shown in FIG. 10, a large sized toothed wheel 362 is fixed to the side surface of the chain wheel 12C. A supporting arm 364 is supported in a horizontal fashion at the rear surface of the inner mast 10B so as to position downwardly of the large sized toothed wheel 362. A rotary encoder 102″ serving as the lifting height sensor 102 is fitted over the supporting arm 364 through a U-shaped mounting metal fitting 366. A small sized toothed wheel 370 meshing with the large sized toothed wheel 362 is fitted over an input axle 368 of the rotary encoder 102″. When the input axle 368 is rotated in the forward and backward directions, the rotary encoder 102″ produces at the same time two kinds of pulses, one having a phase different from that of the other, for calculating the lifting height value.

A detecting mechanism for detecting a backwardly inclined angle $\alpha$ of the outer mast 10A will be described with reference to FIGS. 9 and 11. A pair of semi-circular mounting bands 372 and 374 are clamped along the outer periphery of the cylinder body 348T of the tilt cylinder 348 by means of a bolt 376. An operating portion 374*b* with an elongated bore 374*a* is constituted by extending the upper end portion of the mounting band 374 in the upper direction.

Figure 11:
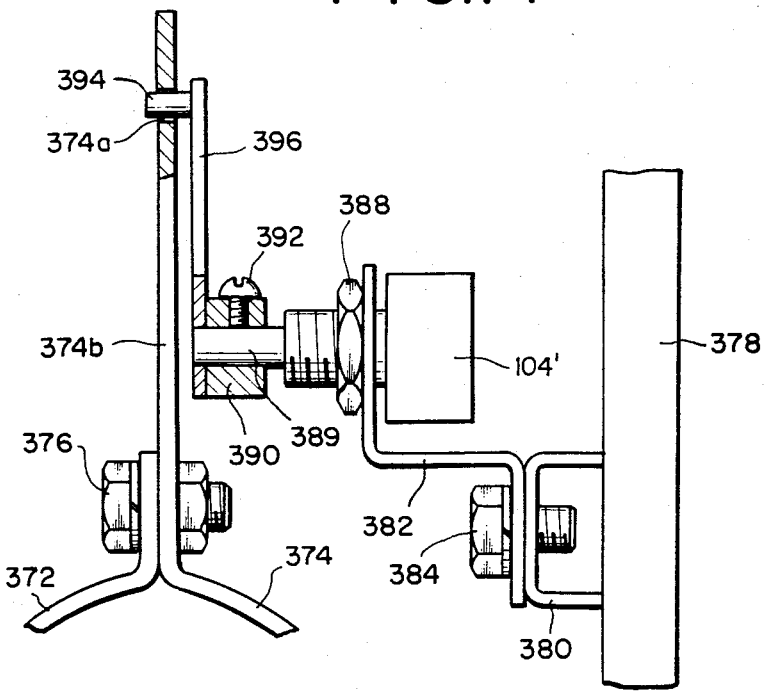
FIG. 11 is a front view illustrating an embodiment of a tilting angle sensor shown in FIG. 2.
Figure 13:
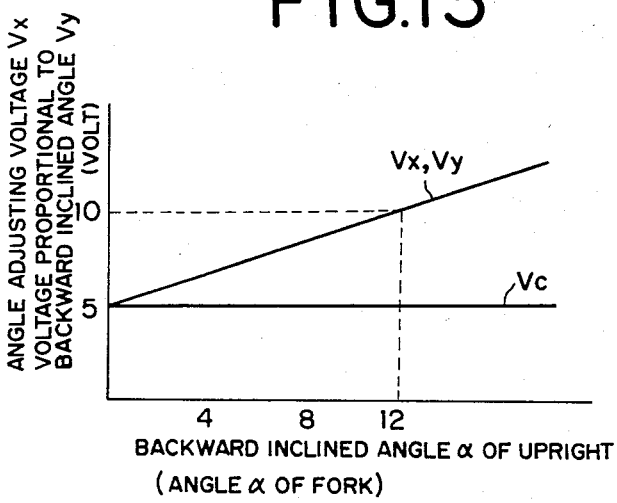
FIG. 13 is a graph illustrating a relationship between a backward inclined angle of an upright and the concerned voltages in the second embodiment shown in FIG. 12.

On the other hand, a U-shaped base metal fitting 380 is welded to the one side of an instrument panel 378 projected on the upper surface of the vehicle body 20, as shown in FIG. 11, so as to correspond to the operating portion 374*b*. A supporting plate 382 shaped as shown in Figure is supported on the left side surface of the metal fitting 380 by means of a bolt 384. A potentiometer 104' is clamped to the supporting plate 382 by means of a nut 388. A mounting boss 390 is clamped to a movable terminal 389 of the potentiometer 104' by means of a screw member 392. An arm 396 is provided with a root portion fitted to the mounting boss 390, and a free end portion on which a pin 394 is provided. The pin 394 is fitted into elongated bore 374*a* of the operating portion 374*b*. In this embodiment, the outer mast 10A is inclined backwardly by the tilt cylinder 348. When the tilt cylinder 348 is rotated in the clockwise direction in FIG. 9 with connecting pin 352 serving as the center of the rotation, the operating portion 374*b* is moved upwardly together with the cylinder body 346T. As a result, the movable terminal 389 of the potentiometer 104' is rotated through the pin 394 and the arm 396. The output voltage of the potentiometer 104' (hereinafter called "the voltage proportional to the backwardly inclined angle", which is the same meaning as that of the voltage proportional to the angle of the fork 18) increases in proportion to the backwardly inclined angle $\alpha$ of the outer mast 10A, as shown in FIG. 13.

Figure 12:
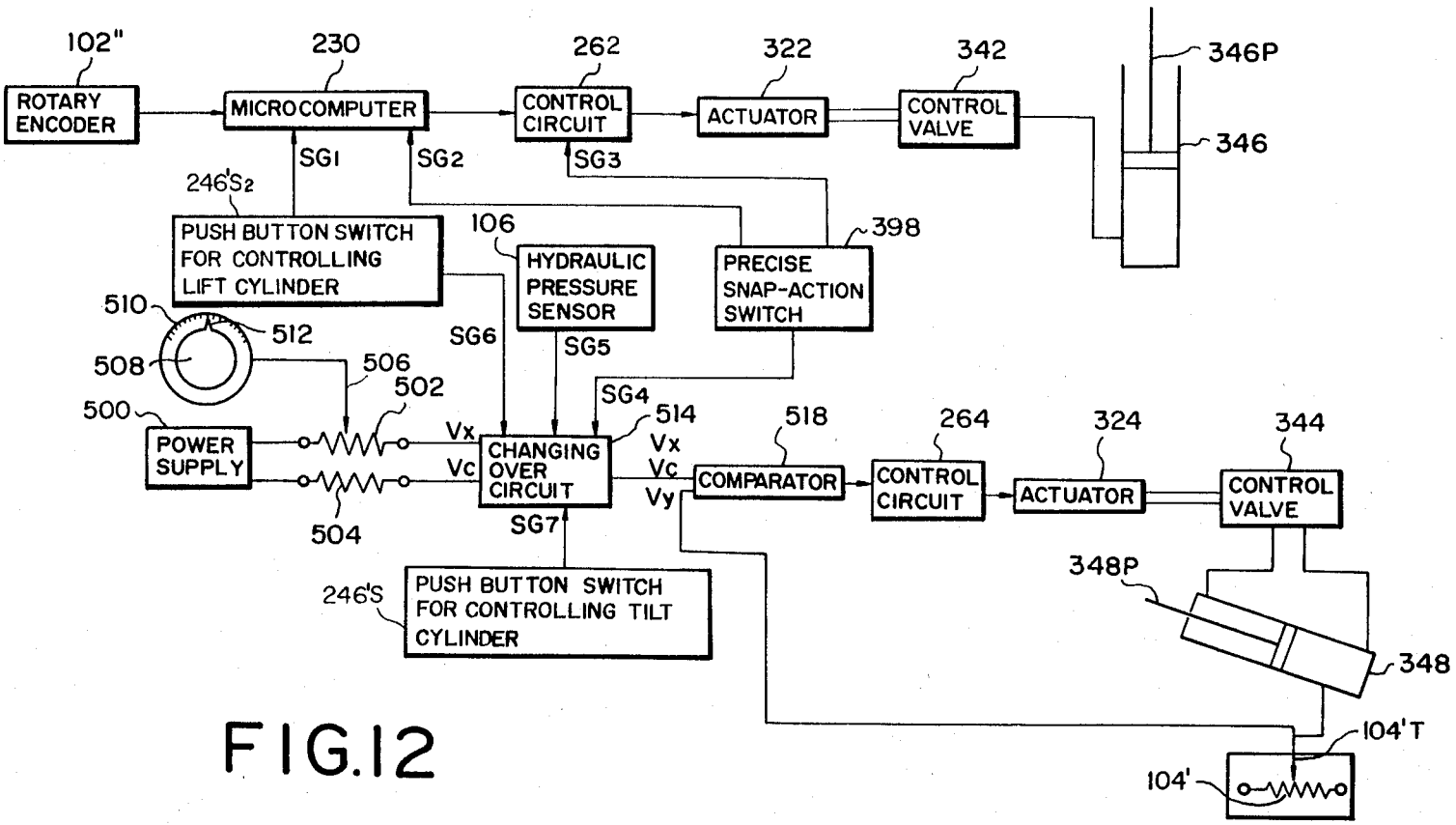
FIG. 12 is a block diagram illustrating a third embodiment of a control device for a loading and unloading mechanism according to the present invention.

An automatic running attitude control device and an automatic horizontal positioning control device according to the third embodiment of the invention will be described with reference to FIG. 12.

The microcomputer 230 is assembled in an operating box 297 (see FIG. 10) provided below the operator's seat 26 (see FIG. 2) of the fork lift truck. The microcomputer 230 judges to whether the fork 18 is lifting or lowering in accordance with the two kinds of pulses, one having a phase different from that of the other, fed from the rotary encoder 102", and calculates the lifting height value of the fork 18 to indicate the same on a suitable display.

A precision snap-acting switch 398 is mounted on an external side surface of the outer mast 10A. The precision snap-acting switch 398 is provided for setting the lifting height H of the fork 18 with respect to ground G to the predetermined height (for instance, 33 cm) suitable for running, as shown in FIG. 9. In relation to the precision snap-acting switch 398, a dog 400 is engaged with the one side of the inner mast 10B. When the lifting height H of the fork 18 reaches the predetermined height (e.g. 33 cm), the precision snap-acting switch 398 is actuated by the dog 400. Thus, a reset signal $SG_2$, for resetting so that the lifting height of the fork 18 is 33 cm, is fed to the microcomputer 230.

A push-button switch 246'$S_2$ for controlling the lift cylinder 346 is provided on the upper surface of the operating panel (not shown) of the operating box 397. When the push-button switch 246'$S_2$ is pressed, a command signal $SG_1$ for lifting and lowering the fork is fed to the microcomputer 230. When the lifting height H of the fork 18 is below the predetermined height (33 cm) suitable for running, a command signal for rotating in the forward direction is fed to the first control circuit 262 connected to the actuator 322 which operates the control valve 342 for hydraulically controlling the lift cylinder 346 from the microcomputer 230. When the fork 18 is above the predetermined height, the microcomputer 230 feeds to the control circuit 262 a command signal for rotating the backward direction. Further, when the fork 18 is moved to the predetermined height, whereby the precision snap-acting switch 398 is actuated by the dog 400, a stopping command signal $SG_3$ is fed to the control circuit 262 from the precision snap-acting switch 398.

Reference numeral 502 denotes a variable resistor for producing a voltage Vx for adjusting an angle so that the horizontal portion 18H of the fork 18 is suitable for running according to kinds and the shape of the load. Reference numeral 504 denotes a fixed resistor for producing a constant voltage Vc (e.g. 5 volt in FIG. 12 embodiment) for setting that the fork 18 is placed in holizontal condition. These are connected in parallel with a DC power supply 500. The variable resistor 502 is incorporated in the operating box 297. The movable terminal 506 thereof projects on the upper surface of the operating panel of the box 297. An adjusting knob 508 for adjusting the angle of running attitude of the fork 18 is fitted to the movable terminal 506. An indicator 512 for indicating the angle of the fork provided on the upper surface of the operating panel is fitted to the knob 508 in relation to the scale 510 for showing angle. In the embodiment, when the adjusting knob 508 is rotated in the direction that the angle of the fork is large as shown in FIG. 13, the voltage Vx for adjusting the angle of the fork increases together with the voltage Vy proportional to the inclined angle.

A change-over circuit 514 is connected to the variable resistor 502 and the fixed resistor 504. The command signal $SG_4$ indicating the changing of the circuit fed from the precision snap-acting switch 398 is fed to the change-over circuit 514. The changing command signal $SG_5$ fed from a pressure sensor 106 which is provided in a hydraulic pressure circuit and becomes operative when the hydraulic pressure is above the predetermined value, that is, when the weight of the load mounted on the fork 18 is above the predetermined value, is fed to the change-over circuit 514. Further, the change-over command signal $SG_6$ is fed to the change-over circuit 514 when the push-button switch 246'$S_2$ for automatic running attitude of the fork becomes operative. The change-over circuit 514 is changed to the variable resistor 502 to produce a voltage Vx for adjusting the angle of the fork from the changing circuit 514, solely when the following conditions are held:

One condition is that the fork 18 is moved to the predetermined height (33 cm), so that the precision snap-acting switch 398 becomes operative.

A second condition is that the pressure sensor 106 becomes operative, so that three changing command signals $SG_4$ to $SG_6$ are fed to the change-over circuit 514.

The change-over circuit 514 is designed so that the changing command signal $SG_7$ is fed thereto when the push-button switch 246'$S_1$ for controlling tilt cylinder provided on the operating box 398 is switched on. When the push-button switch 246'$S_1$ is actuated so that the change-over circuit 514 is changed to the fixed resistor 504, a constant voltage Vc for placing the fork in the horizontal condition is fed from the change-over circuit 514.

A comparator 518 capable of feeding the stop command signal indicative of forward and backward rotation to the second control circuit 264 of the second actuator 324 for operating the control valve 344 of the tilt cylinder 348, is connected to the potentiometer 104' and the change-over circuit 514. When the angle setting voltage Vx or the constant voltage Vc is fed from the change-over circuit 514, the comparator 518 compares the voltage Vx (or Vc) with the voltage Vy proportional to the backwardly inclined angle fed from the potentiometer 104'. When the voltage Vy is larger than the other voltage Vx (or Vc), that is, the actual angle of the fork is larger than the objective angle therefor, the forward rotating command signal is fed from the comparator 518, with the result that the outer mast 10A is rotated in the forward direction (in the direction that the voltage Vy becomes small) by the tilt cylinder 346. Further, when the voltage Vy is equal to the other voltage Vx (or Vc), the stop command signal is fed from the comparator 518 so that the tilt cylinder 348 is stopped.

On the contrary, when the voltage Vy is smaller than the voltage Vx (or Vc), that is, the actual angle of the fork is smaller than the objective angle therefore, the reverse rotating command signal is fed from the comparator 518 so that the outer mast 10A is rotated backward (in the direction that the voltage Vy becomes large) by the tilt cylinder 348.

The voltage Vy proportional to the inclined angle is always applied to the comparator 518 from the potentiometer 104'. The comparator 104' becomes operative solely when the voltage Vx or Vc is applied thereto.

The operation of the automatic running attitute control device and the automatic horizontal control device for a fork thus constructed will be described.

FIG. 9 shows that the fork 18 is stopped at a position lower than the predetermined height (33 cm), the masts 10A and 10B are placed in a vertical condition (the angle of the fork is zero), the inclined angle proportional voltage Vy fed from the potentiometer 104' is 5 V, and a suitable load is mounted on the fork 18. Prior to the operation for moving the fork 18 from such a condition to the desired running attitude position, the adjusting knob 508 is actuated so that the indicator 512 thereof is set to the objective angle (for instance, 12 degrees) of the scale 510 showing the angle of the fork, and the angle adjusting voltage Vx of 10 volt corresponding to the objective angle is fed to the change-over circuit 514 from the variable resistor 502.

When the push-button switch 246'$S_2$ for controlling lift cylinder is pressed, the command signal $SG_1$ for lifting and lowering is fed to the microcomputer 230. The command signal for rotating in the forward and backward directions is fed to the control circuit 262 from the microcomputer 230, with the result that the fork 18 is moved upwards by the lift cylinder 346. When the lifting height H of the fork 18 reaches the predetermined height (33 cm), the precision snap-acting switch 398 is actuated by the dog 400. As a result, the reset signal $SG_2$ is fed to the microcomputer 230 from the precision snap-acting switch 398. As a result, it is indicated that the lifting height of the fork 18 is 33 cm. On the other hand, the stop command signal $SG_3$ for lift cylinder is fed to the control circuit 262, with the result that the fork 18 is stopped at the predetermined height. At the same time, three changing command signals $SG_4$ to $SG_6$ are fed to the change-over circuit 514. As a result, the change-over circuit 514 is connected to the variable resistor 502. As a result, the angle adjusting voltage Vx of 10 volts previously set is fed to the comparator 518 from the change-over circuit 514. The comparator 518 compares the voltage Vx of 10 volts with the voltage Vy of 5 volts from the potentiometer 104'. In this instance, since the voltage Vx is larger than the voltage Vy, the comparator 518 produces the inversing rotation command signal. As a result, the outer mast 10A is inclined backwardly by the tilt cylinder 348. According to this action, the movable terminal 104'T of the potentiometer 104' is rotated so that the voltage Vy becomes large. When the voltage Vy is equal to 10 volts which is the same voltage as that of the voltage Vx, the comparator 518 produces a stop command signal. As a result, the tilt cylinder 348 is stopped. Thus, the fork 18 is stopped at the inclined position of 12 degrees of the objective angle.

On the other hand, assuming that the fork 18 is a predetermined lifting height position and is inclined at a constant angle, and the backward inclined proportional voltage Vy is above 5 V. In such a condition, when the push-button switch 246$S_1$ for controlling tilt cylinder is pressed in order to place the fork 18 in the horizontal position, the changing signal $SG_7$ is fed to the change-over circuit 514. As a result, the circuit 514 is connected to the fixed resistor 504. The circuit 514 produces a constant voltage Vc of 5 volts. Thus, the comparator 518 compares the voltage Vy with the voltage Vc. Since the voltage Vy is larger than the constant voltage Vc, the comparator 518 produces a command signal indicative of forward rotation. As a result, the fork 18 is rotated toward the horizontal position. When the voltage Vy is equal to the constant voltage Vc, that is, 5 V, the fork 18 is stopped at the horizontal position.

Thus, in the above-mentioned embodiment, the automatic running attitude operation and the automatic horizontal operation are effected. In this embodiment, when the fork is stopped at the constant lifting height position in response to the operation of the precision snap-acting switch 398 and the pressure sensor 106 becomes operative, the change-over circuit 514 produces an angle adjusting voltage Vx. The comparator 518 compares the voltage Vx with the voltage Vy proportional to the backwardly inclined angle varying according to the inclined angle $\alpha$ of the upright 10. When the voltage Vy is equal to the voltage Vx, the circuit 518 produces a stop command signal of the tilt cylinder 348. The angle adjusting voltage Vx is adjustable with the adjusting knob 508. As a result, this makes it possible to adjust the angle $\alpha$ of the fork 18 in the running attitude condition with the adjusting knob 508 so as to meet the kinds of the load or the shape thereof.

The present embodiment may be embodied as follows. (1) Instead of the signal rendered to the change-over circuit 514 by the pressure sensor 106, when there is no load or the weight of the load is very light, the device is designed so that the running attitude control is effected at the desired backward inclined angle.

(2) The fixed resistor 504, the change-over circuit 514, and the push-button switch 246$S_1$ for controlling tilt cylinder may be omitted. The device is designed so that the voltage Vx of the variable resistor 502 is fed to the comparator 518 when the push-button switch 246$S_2$ for controlling the lift cylinder, the pressure sensor 106, and the precision snap-acting switch 398 are all in operative condition. (3) An additional running attitude button (not shown) for actuating the precision snap-acting switch 398 is further provided. When it is required to move the fork to the running attitude position, the running attitude push-button switch is actuated so that the precision snap-acting switch 398 is placed in an operative condition to lift or lower the fork with a manual actuating lever. When the fork is moved to the predetermined lifting height position, the precision snap-acting switch 398 is designed to become operative.

According to the third embodiment of the invention, when the fork is moved to the predetermined height suitable for running, the voltage proportional to the backwardly inclined angle of the upright is compared with the voltage for adjusting an angle of the upright, and when the former is equal to the latter, the stop command signal for tilt cylinder is produced. Accordingly, this makes it possible to adjust the angle of the running attitude of the fork during the loading and unloading work to the kinds of the loads and the shape thereof.

Reference is made to the fourth embodiment of the present invention. The feature of the present embodiment resides in that according as the lifting height of the fork increases, the region for adjusting an angle of the running attitude of the fork is narrowed. For this purpose, the voltage proportional to the lifting height of the fork is compared with the voltage proportional to the backwardly inclined angle of the upright, and when the former is equal to the latter, a command for stopping the operation is fed to the tilt cylinder.

Figure 14:
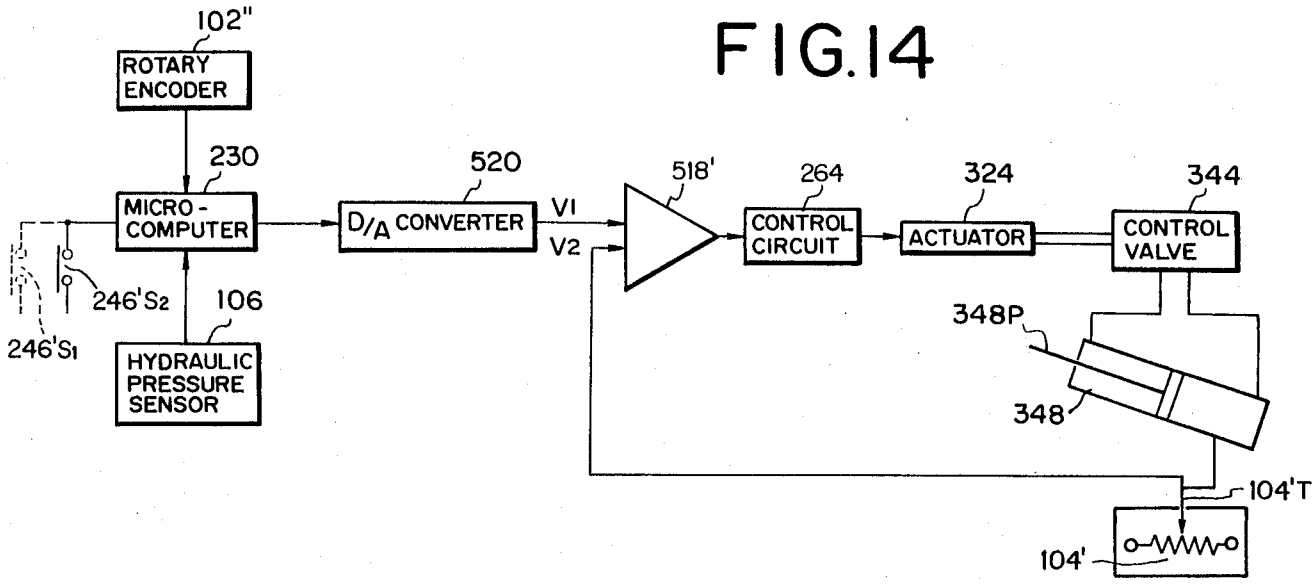
FIG. 14 is a block diagram illustrating a fourth embodiment of a control device for loading and unloading mechanism according to the present invention.

The tilting angle device according to the present embodiment will be described with reference to FIG. 14, wherein the same reference numerals used in FIG. 12 denote corresponding parts, respectively.

The microcomputer 230 judges whether the fork 18 lifts or lowers and calculates the lifting height value of the fork 18 in accordance with two kinds of pulse signals, each having a different phase, being fed to the rotary encoder 102''. The pressure sensor 106 is provided in the hydraulic pressure circuit for the lift cylinder 346. When the hydraulic pressure is above the predetermined value, that is, when a load larger than the predetermined weight is mounted on the fork 18, the hydraulic pressure sensor 106 feeds a load sensing signal to the microcomputer 230. The microcomputer 230 judges that the fork is placed in a stooped condition due to the two kinds of pulse signals and feeds the calculated lifting height value (digital value) to the D/A converter 520 in response to the load sensing signal. In the embodiment, D/A converter 520 is designed so as to produce a lifting height proportional voltage $V_1$ which decreases as the lifting height value (digital value) of the fork 18 increases. The D/A converter 520 and the potentiometer 104'' are connected to the comparator 518'. The comparator 518' compares the lifting height proportional voltage fed from the D/A converter 520 with the backward inclined angle proportional voltage $V_2$ fed from the potentiometer 104'' to produce a stop command signal for stopping the actuation of the tilt cylinder 348, when the voltage $V_1$ is equal to the voltage $V_2$. The control circuit 264 which supplies the stop signal to the actuator 324 of the control valve 344 for actuating the tilt cylinder 348 is connected to the comparator 518'.

The operation of the fork angle control device thus constructed will be described.

Figure 15:
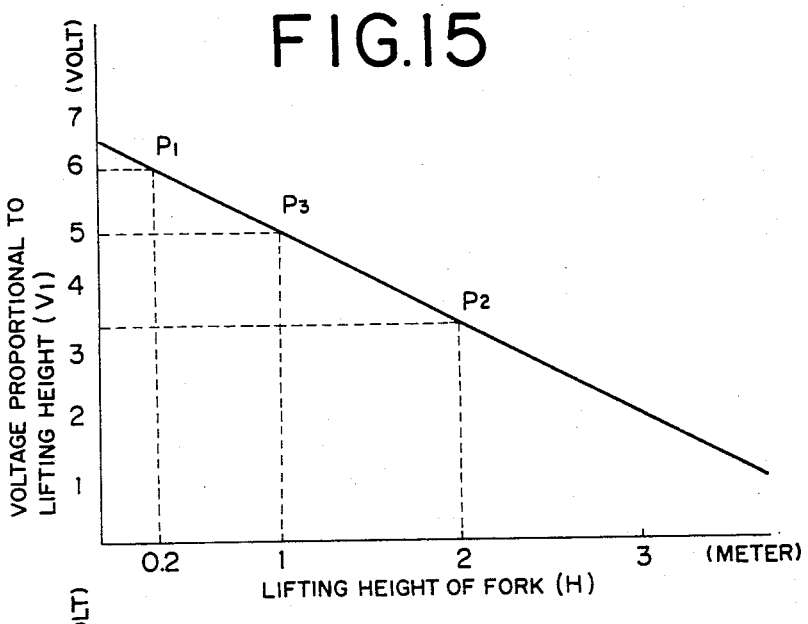
FIG. 15 is a graph illustrating a relationship between the lifting height of a fork and a voltage proportional to the lifting height.

The initial condition of the fork 18 is shown in FIG. 9 by a solid line. In this condition, the lifting height H is 0.2 m. The pressure sensor 106 produces a load detecting signal indicating that the weight of the load larger than the predetermined value is mounted to the fork 18. The D/A converter 520 produces a lifting height proportional voltage $V_1$ of 6.0 volt labelled by $P_1$ in FIG. 15. The outer mast 10A is placed in a vertical position. The potentiometer 104' produces a backwardly inclined angle proportional voltage $V_2$ of 2.0 volt labelled by $P'_1$ in FIG. 16.

When the push-button switch 246'$S_2$ for starting automatic lifting height is pressed in this condition, the fork 18 automatically elevates until it reaches the objective lifting height position (for instance, 2 m) and then is stopped thereat. In case of need, a push-button switch 246'$S_1$ for starting automatic holizontally control may be used. As a result, the lifting height proportional voltage $V_1$ is 3.5 volt labelled by $P_2$ in FIG. 15. The fork 18 is stopped at the objective lifting height position. When the operating command for tilt cylinder 348 is produced from the microcomputer 230, the control valve 344 becomes operative due to the output of the actuator 324. As a result, the tilt cylinder 348 becomes operative, so that the outer mast 10A is inclined backward. As a result, the movable terminal 104'T of the potentiometer 104' is rotated. The backward inclined angle proportional voltage $V_2$ rises from the above-mentioned 2.0 volt. When the voltage $V_2$ is 3.5 volt labelled by $P'_2$ in FIG. 16, the lifting height proportional voltage $V_1$ (3.5 volt) is equal to the backwards inclined angle proportional voltage $V_2$. As a result, the comparator 518' feeds a stop command signal to the control circuit 264 to stop the actuator 324. Thus, the control valve 344 is returned to the fully closed position so that the tilt cylinder 348 is stopped. Accordingly, the outer mast 10A is stopped at the position inclined backwards by 5 degree as labelled by $P'_2$ in FIG. 16.

Figure 16:
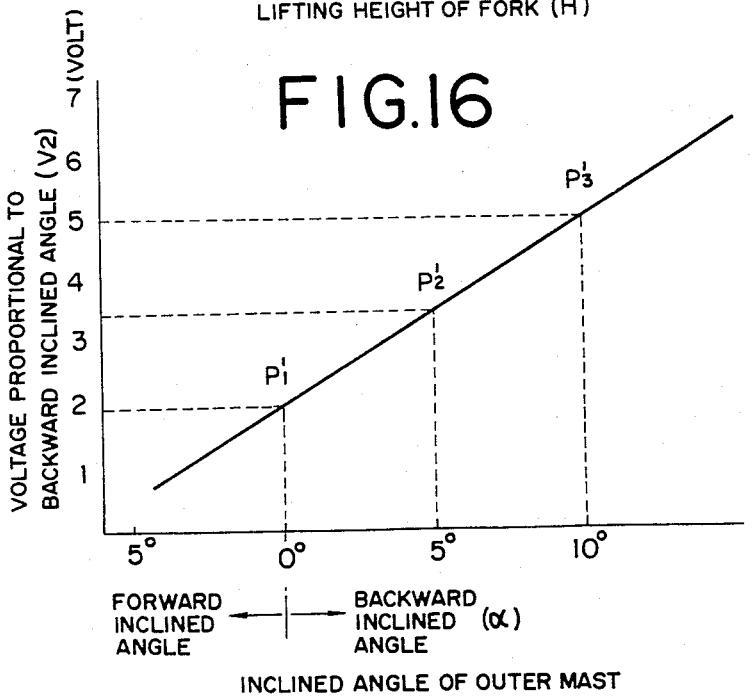
FIG. 16 is a graph illustrating a relationship between the backward inclined angle and the voltage proportional to the backward tilting angle in the fourth embodiment of the invention.

When the lifting height of the fork 18 is lowered from 2 m to 1 m by the closing of the automatic lifting height starting push-button switch 246'$S_2$, the lifting height proportional voltage $V_1$ is 5 volt labelled by $P_3$ in FIG. 16. The tilt cylinder 348 moves until the backwards angle proportional voltage $V_2$ is 5 volt which is the same voltage as that of the voltage $V_1$ and then is stopped. In this instance, the backward inclined angle $\alpha$ of the outer mast 10A is 10°. This backward inclined angle $\alpha$ is larger than the backward inclined angle (5°) when the lifting height of the fork 18 is 2 m.

The fork control device according to the embodiment of the invention is characterized in that a lifting height proportional voltage $V_1$, which lowers according as the lifting height H of the fork increases is produced by the microcomputer 230, and in that the backward inclined angle proportional voltage $V_2$ which increases according as the backward inclined angle $\alpha$ of the outer mast 10A becomes large is produced by the potentiometer 104', and in that when the voltage $V_1$ is equal to the voltage $V_2$, the comparator 518' produces a signal for stopping the operation of the tilt cylinder 348. This makes it possible that the backward inclined angle $\alpha$ of the outer mast 10A is controlled so as to become small, according as the lifting height of the fork 18 increases. Further, this makes it possible to eliminate a situation in which the gravity center is out of the stable region, thereby improving safety.

The present embodiment may be embodied as follows:

(1) In the embodiment, the device is designed so as to produce a lifting height proportional voltage $V_1$ from the D/A converter 520 on the basis of the calculated lifting height value by the rotary encoder 102'' and the microcomputer 230.

Instead of this, the construction may be designed so as to fit a small toothed wheel (not shown) over the chain wheel 12, and mesh a reduced toothed wheel (not shown) with the small toothed wheel, thereby to rotate the movable terminal of the potentiometer (not shown) for producing the lifting height proportional voltage.

(2) The pressure sensor 106 may be omitted.

The fourth embodiment of the present invention is constituted so as to compare the voltage proportional to the lifting height varying proportional to the lifting height H of the fork with the voltage proportional to the backwardly inclined angle and feeds a command for stopping the operation of the tilt cylinder for tilting the upright, when the former is equal to the latter. Accordingly, this makes it possible to narrow the adjustable region for backward inclined angle of the upright, that is, the angle of the fork according as the lifting height becomes high, thereby improving a safety.

Although several preferred embodiments of the present invention have been illustrated and described, it is believed evident to those skilled in the art that many changes and variations may be made without departing from the spirit and scope of the present invention. Accordingly, the present invention is to be considered as limited by the following claims.

What is claimed is:

1. In a control device for a loading and unloading mechanism adapted to a fork lift truck comprising:

(a) a sensor means (100) including a lifting height sensor means (102) for measuring the lifting height of a fork and providing an output signal indicative thereof, and an inclination sensor means (104) for measuring the inclination of an upright and producing an output signal indicative thereof;

(b) an interface circuit (220), provided in a control unit (200), including a lifting height counter means (222) for counting output signals from the sensor means;

(c) a control command producing circuit (240) provided in the control unit (200), said control command producing circuit (240) including a memory means (244) for storing data indicative of lifting height and inclination required for running attitude control, and data setting means (246) for setting data indicative of running attitude into memory, said control command producing circuit (240) producing a command signal indicative of valve opening based on a comparison between the output signals of the sensor means (100) and the data stored in the memory means;

(d) a servomotor driving circuit means (320) responsive to the command signal indicative of valve opening from the control unit for producing a drive control signal, and (e) a hydraulic pressure driving circuit means (340) responsive to the drive control signal for producing a control signal for hydraulically controlling a lift cylinder (346) and a tilt cylinder (348), the improvement wherein said sensor means (100) further includes a load sensor (106) comprising at least one of means for detecting hydraulic pressure and means for decreasing air pressure in a front wheel of the fork lift truck, said data setting means (246) includes a push-button switch means ($246S_1$) for generating a fork attitude control command, said control command producing circuit (240) includes horizontal positioning means responsive to the push-button switch means after pick-up or stacking of a load is completed, to produce said command signal indicative of valve opening for controlling the tilt cylinder in accordance with an angle of inclination preselected by an output signal of said load sensor and in accordance with the output signal from said inclination sensor means, thereby effecting a horizontal positioning control, and a control circuit (160) provided in said control unit (200) comprising adjusting means for adjusting a preset inclination of the fork in accordance with the nature or shape of a load and providing an output voltage, and comparing means for comparing the output voltage of said adjusting means with a voltage proportional to rearward inclination of the tilt cylinder, whereby when the former is equal to the latter under the condition that the fork is at a predetermined lifting height, said control circuit produces a control signal for stopping the operation of the tilt cylinder.

2. A control device for a loading and unloading mechanism according to claim 1, wherein said control command producing circuit (240) includes first means for producing a first control command for controlling the lift cylinder so as to lower the fork to a running position in accordance with the output signal of said lifting height sensor means after said horizontal positioning control is carried out, and a second means, operable when the fork reaches a predetermined running height, for producing a second control command for controlling the tilt cylinder to adjust the inclination of the upright to a predetermined inclination for a running operation of the vehicle in accordance with the output of the tilting angle sensor means.

3. A control device for a loading and unloading mechanism according to one of claims 1 or 2, wherein said tilting angle sensor means (104) comprises a potentiometer producing an output proportional to an operating angle of the tilt cylinder.

4. A control device for a loading and unloading mechanism according to claim 1, including means for stopping the fork at a predetermined lifting height having a precision snap-acting switch mounted on a stationary part of the upright and responsive to operation of the hydraulic pressure driving circuit means, and operating means for operating the precision snap-acting switch when the fork reaches a predetermined position.

5. A control device for a loading and unloading mechanism according to one of claims 1 or 2 wherein a control circuit means (160) provided in said control unit comprises first means for producing an output proportional to a lifting height, second means for producing an output proportional to rearward inclination, and comparing means for comparing the output of said first means with the output of said second means, said control circuit means producing a command for stopping operation of the tilt cylinder when the output of said first menas is equal to the output of said second means.

6. A control device for a loading an unloading mechanism according to claim 5 including means for feeding a signal indicative of lifting movement and height to said first means comprising a rotary encoder means including means for determining the direction of vertical movement of the fork by producing two kinds of pulse signals having different phases.

7. In a control device for a loading and unloading mechanism adapted to a fork lift truck comprising:

(a) a sensor means (100) including a lifting height sensor means (102) for measuring the lifting height of a fork and providing an output signal indicative thereof, and an inclination sensor means (104) for measuring the inclination of an upright and producing an output signal indicative thereof;

(b) an interface circuit (220) provided in a control unit (200), including a lifting height counter means (222) for counting output signals from the sensor means;

(c) a control command producing circuit (240) provided in the control unit (200), said control command producing circuit (240) including a memory means (244) for storing data indicative of lifting height and inclination required for running attitude control, and data setting means (246) for setting data indicative of running attitude into memory, said control command producing circuit (240) producing a command signal indicative of valve opening based on a comparison between the output signals of the sensor means (100) and the data stored in the memory means;

(d) a servomotor driving circuit means (320) responsive to the command signal indicative of valve opening from the control unit for producing a drive control signal, and (e) a hydraulic pressure driving circuit means (340) responsive to the drive control signal for producing a control signal for hydraulically controlling a lift cylinder (346) and a tilt cylinder (348), the improvement wherein said sensor means (100) further includes a load sensor means for detecting a load and providing output signals quantitatively indicative of the load supported by said fork, said control command producing circuit includes horizontal position control means responsive to said load sensor means output signals for controlling said tilt cylinder dependent on the detected load supported by said fork, and a conrol circuit (160) provided in said control unit (200) comprising adjusting means for adjusting a preset inclination of the fork in accordance with the nature or shape of a load and providing an output voltage, and comparing means for comparing the output voltage of said adjusting means with a voltage proportional to rearward inclination of the tilt cylinder, whereby when the former is equal to the latter under the condition that the fork is at a predetermined lifting height, said control circuit produces a control signal for stopping the operation of the tilt cylinder.

8. A control device for a loading and unloading mechanism according to claim 7 wherein said horizontal position control means further comprises limiting means responsive to said output signals from said height sensor for limiting a permissible range of inclination of the upright as a function of the detected height of said fork.

9. In a method of controlling horizontal positioning of a fork in a fork lift truck comprising the steps of measuring lifting height of the fork, measuring inclination of and upright supporting the fork, controlling said fork to a predetermined height and adjusting inclination of said upright, the improvement comprising the steps of:

measuring load supported by said fork, and adjusting the inclination of said upright as a function of the measured load supported by said fork, said adjusting step comprising the steps of adjusting a preset inclination of the fork in accordance with the nature or shape of the measured load supported by said fork and providing an output voltage, and comparing the provided output voltage with a voltage proportional to rearward inclination of the tilt cylinder, whereby when the former is equal to the latter under the condition that the fork is at a predetermined lifting height, a control signal is produced for stopping the operation of the tilt cylinder.

10. The method of controlling horizontal positioning of a fork in a fork lift as recited in claim 9 comprising the further step of limiting said adjusting step for the inclination of said upright as a function of the measured lifting height of said fork.

* * * * *